US011358257B2

(12) United States Patent
Redman

(10) Patent No.: US 11,358,257 B2
(45) Date of Patent: Jun. 14, 2022

(54) MAGNETIC CLAMPING DEVICE

(71) Applicant: Kenneth K. Redman, Fredonia, WI (US)

(72) Inventor: Kenneth K. Redman, Fredonia, WI (US)

( * ) Notice: Subject to any disclaimer, the term of this patent is extended or adjusted under 35 U.S.C. 154(b) by 250 days.

(21) Appl. No.: 16/454,469

(22) Filed: Jun. 27, 2019

(65) Prior Publication Data

US 2020/0130146 A1 Apr. 30, 2020

Related U.S. Application Data

(60) Provisional application No. 62/750,939, filed on Oct. 26, 2018.

(51) Int. Cl.
*B25B 11/00* (2006.01)

(52) U.S. Cl.
CPC ..... *B25B 11/002* (2013.01)

(58) Field of Classification Search
CPC ..... B25B 11/00; B25B 11/002; B25B 11/02
See application file for complete search history.

(56) References Cited

U.S. PATENT DOCUMENTS

| | | | |
|---|---|---|---|
| 2,117,132 | A | 5/1938 | Baermann, Jr. |
| 2,287,286 | A | 6/1942 | Bing et al. |
| 4,055,824 | A | 10/1977 | Baermann |
| 4,099,755 | A | 7/1978 | Anderson |
| 4,251,791 | A | 2/1981 | Yanagisawa et al. |
| 4,329,673 | A | 5/1982 | Uchikune et al. |
| 4,981,795 | A | 1/1991 | Cooper |
| 5,266,914 | A | 11/1993 | Dickson et al. |
| 6,707,360 | B2 | 3/2004 | Underwood et al. |
| 7,012,495 | B2 | 3/2006 | Underwood et al. |
| 7,686,287 | B2 * | 3/2010 | Dixon ..... B23Q 1/545 269/75 |
| 8,183,965 | B2 | 5/2012 | Michael |
| 8,604,900 | B2 | 12/2013 | Kocijan |
| 8,878,639 | B2 | 11/2014 | Kocijan |
| 9,484,137 | B2 | 11/2016 | Kocijan |
| 9,818,522 | B2 | 11/2017 | Kocijan |
| 2004/0239460 | A1 | 12/2004 | Kocijan |
| 2005/0012579 | A1 | 1/2005 | Underwood et al. |
| 2009/0027149 | A1 | 1/2009 | Kocijan |
| 2009/0078484 | A1 | 3/2009 | Kocijan |
| 2012/0092104 | A1 | 4/2012 | Kocijan |
| 2012/0200380 | A1 | 8/2012 | Kocijan |
| 2013/0234817 | A1 | 9/2013 | Kocijan |
| 2015/0022299 | A1 | 1/2015 | Kocijan |
| 2015/0042427 | A1 | 2/2015 | Kocijan |

(Continued)

*Primary Examiner* — Lee D Wilson
(74) *Attorney, Agent, or Firm* — Boyle Fredrickson S.C.

(57) ABSTRACT

A magnetic clamping device is provided that includes a housing in which a number of magnets are disposed. A magnetizable core extends through the housing between the magnets and is movable with respect to the housing and the magnets. The core can be moved using a suitable mechanism disposed on the housing between an extended position where the core is positioned in contact with the support surface and a retracted position where the core is spaced from the support surface. The position of the core relative to the housing and the support surface adjusts the magnetic holding force transmitted from the magnets through the core to attract and hold the core on the support surface.

14 Claims, 7 Drawing Sheets

(56) References Cited

U.S. PATENT DOCUMENTS

| | | | | |
|---|---|---|---|---|
| 2015/0042428 | A1 | 2/2015 | Kocijan | |
| 2018/0243855 | A1* | 8/2018 | Scheerer | E04D 5/149 |
| 2020/0130146 | A1* | 4/2020 | Redman | B25B 11/002 |

* cited by examiner

MAGNETIC CLAMPING DEVICE

CROSS-REFERENCE TO RELATED APPLICATIONS

This application claims priority from U.S. Provisional Patent Application Ser. No. 62/750,939 filed in Oct. 26, 2018, the entirety of which is expressly incorporated herein by reference for all purposes.

FIELD OF THE DISCLOSURE

The present disclosure relates generally to clamping devices, and more specifically to a magnetic clamping device for releasably securing objects to a metallic surface or substrate.

BACKGROUND OF THE DISCLOSURE

In the area of construction, often it is necessary to alter, cut or trim a piece of a construction material, such as wood, among others, in order to properly fit the construction material where necessary or desired. To accomplish this, many different styles and types of boring, drilling and/or cutting implements have been developed.

Some often utilized pieces of boring, drilling and/or cutting equipment include a support surface, such as a table on which the material to be cut can be placed, and a boring, drilling or cutting mechanism disposed within and extending above the support surface in order to be engageable with the material placed on the support surface. Devices of this type include table saws, band saws and drill presses having a metal or metallic support surface on which the material to be cut is positioned One shortcoming with regard to devices of this type are issues with the various mechanisms currently utilized to securely position the material to be cut, bored or drilled against the support surface. As the devices employ a metal or metallic support surface, different magnetic securing devices have been developed to clamp the material to the support surface.

However, while these prior art magnetic devices can hold the material on the metal or metallic support surface, they suffer from certain shortcomings in their design and operation, particularly with regard to the complexity of the prior art devices.

Therefore, it is desirable to develop an improved magnetic clamping device for securing a piece of construction material to a metal or metallic support surface of a boring, drilling or cutting mechanism that can address these issues with the prior art.

SUMMARY OF THE DISCLOSURE

According to one aspect of an exemplary embodiment of the invention, a magnetic clamping device includes a housing in which a number of magnets are disposed. A core extends through the housing between the magnets and is movable with respect to the housing and the magnets. The core can be moved using a suitable mechanism disposed on the housing between an extended position where the core is positioned in contact with the support surface and a retracted position where the core is spaced from the support surface. The position of the core relative to the housing and the support surface adjusts the magnetic holding force transmitted from the magnets through the core to attract the core to and hold the core on the support surface.

According to one aspect of another exemplary embodiment of the invention, the core adjustment mechanism is formed with a rotating member operably engaged with the core and the housing to rotate and adjust the position of the core within the housing.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Figure 1:
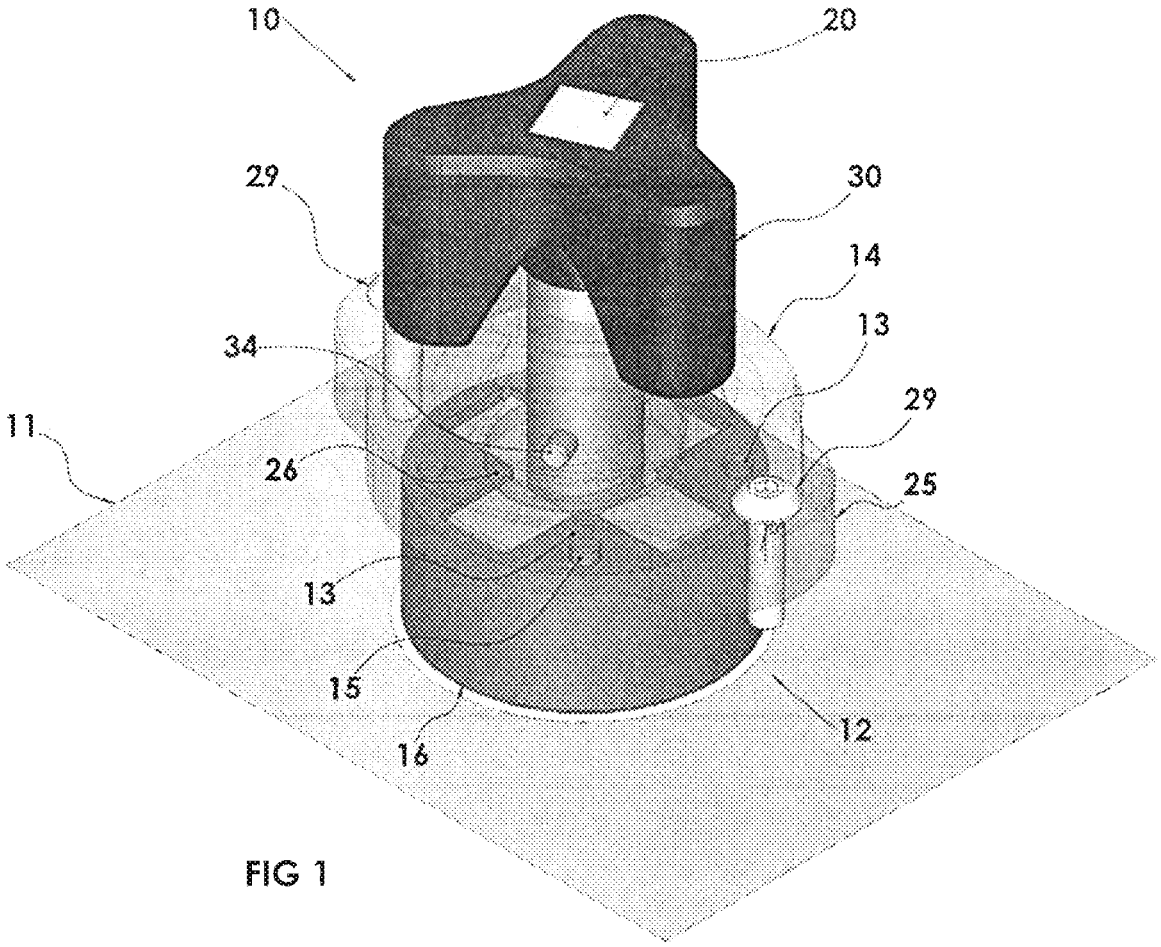
FIG. 1 is an isometric front view of magnetic clamp according to an exemplary embodiment the invention.
Figure 2:
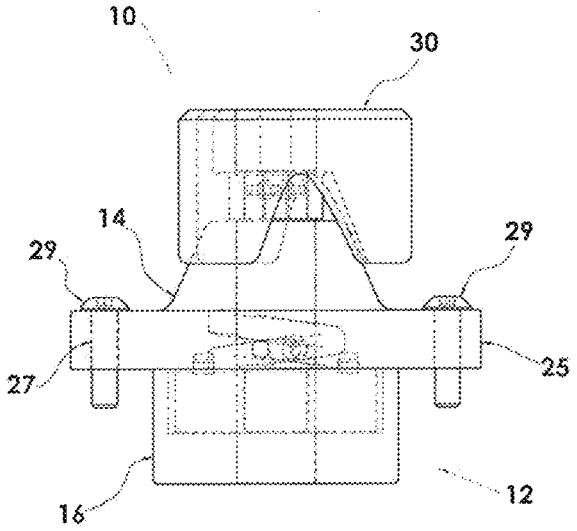
FIG. 2 is a partially broken away front elevation view of the magnetic clamp of FIG. 1 in an engaged position.
Figure 3:
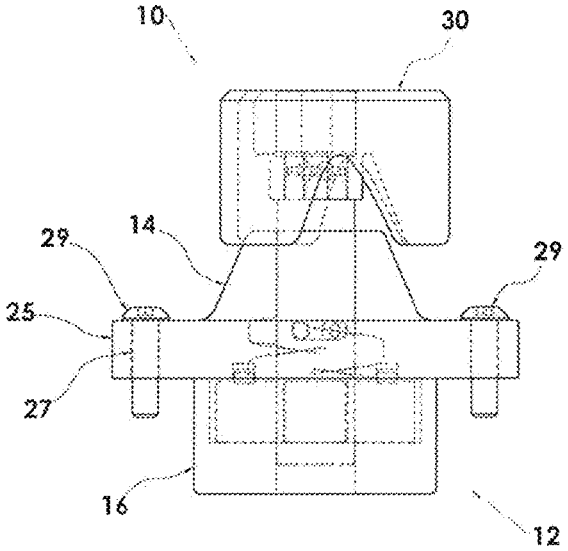
FIG. 3 is a partially broken away front elevation view of the magnetic clamp of FIG. 1 in a disengaged position.
Figure 6:
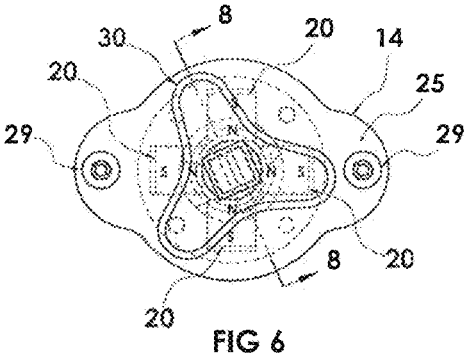
FIG. 6 is a partially broken away top plan view of the magnetic clamp of FIG. 1.
Figure 4:
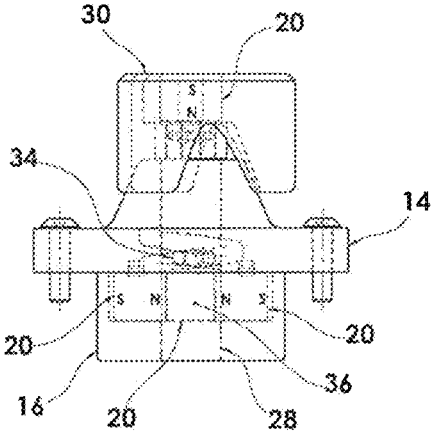
FIG. 4 is a partially broken away front elevation view of the magnetic clamp of FIG. 1.
Figure 5:
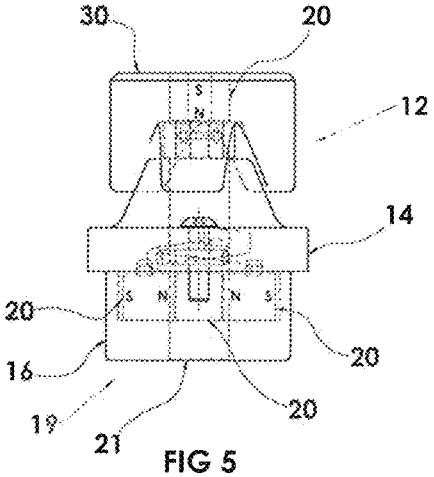
FIG. 5 is a partially broken away right side elevation view of the magnetic clamp of FIG. 1.
Figure 7:
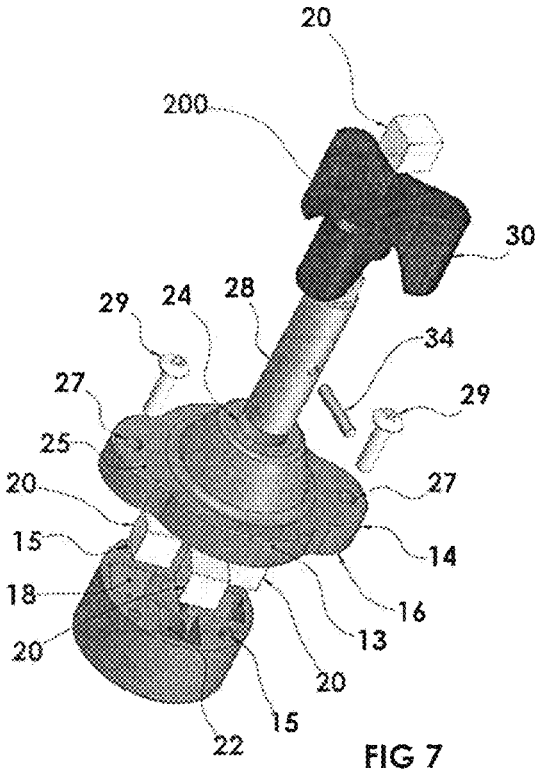
FIG. 7 is an exploded view of the magnetic clamp of FIG. 1.
Figure 8:
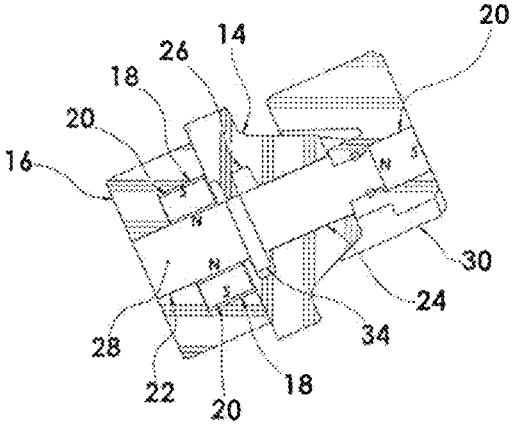
FIG. 8 is a cross-sectional view along line 8-8 of FIG. 5.

Before the present apparatuses and methods are described, it is understood that this disclosure and invention is not limited to the particular embodiments and methodology, as these may vary. It is also to be understood that the terminology used herein is for the purpose of describing particular exemplary embodiments only, and is not intended to limit the scope of the present disclosure and invention which will be limited only by the appended claims.

With reference now to FIGS. 1-8 an exemplary embodiment of a releasable magnetic clamp is illustrated generally at 10. The clamp 10 is releasably securable to a device such as an adjustable fence 100 (FIGS. 9-11) and includes a housing 12 having an upper housing 14 connected to a lower housing 16, such as by using sets of aligned bores 13 and tabs 15 disposed in a complementary configuration on both the upper housing 14 and lower housing 16.

The lower housing 16 includes a number of recesses 18 formed therein and in which are positioned a number of magnets 20. The magnets 20 are disposed around a central passage 22 that extends through the lower housing 16. In an alternative embodiment, the lower housing 16 can include a groove or recess (not shown) disposed between a pair of flanges (not shown) to intersect the space defined by the housing 16 between the flanges.

Figure 9:
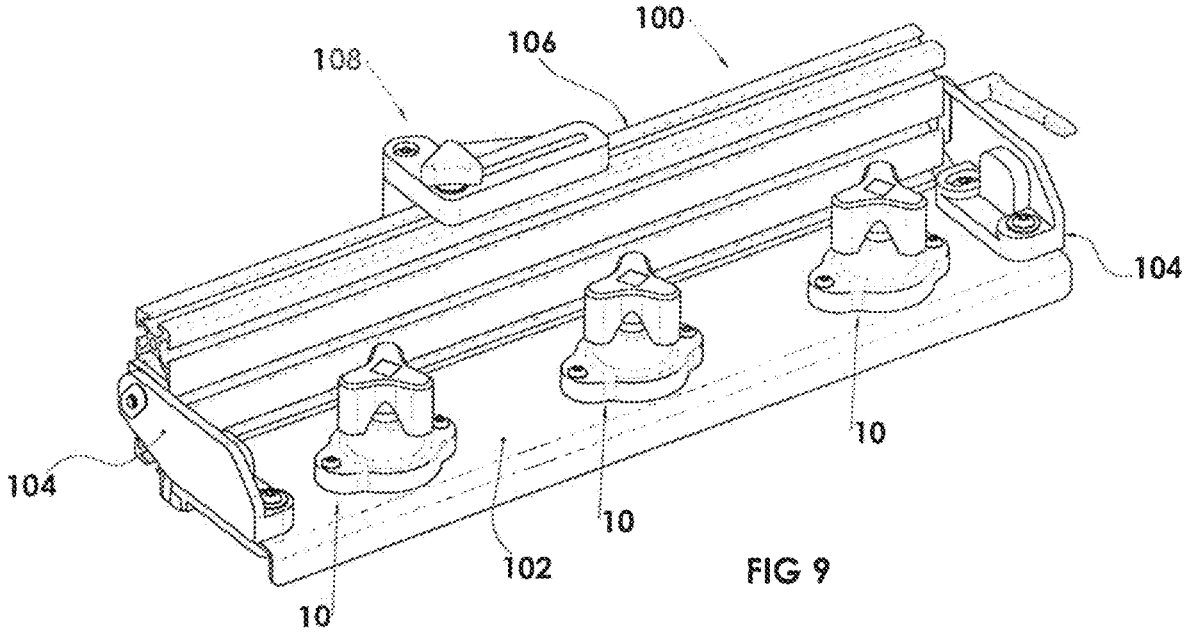
FIG. 9 is an isometric view of an adjustable fence including the clamp of FIG. 1.
Figure 10:
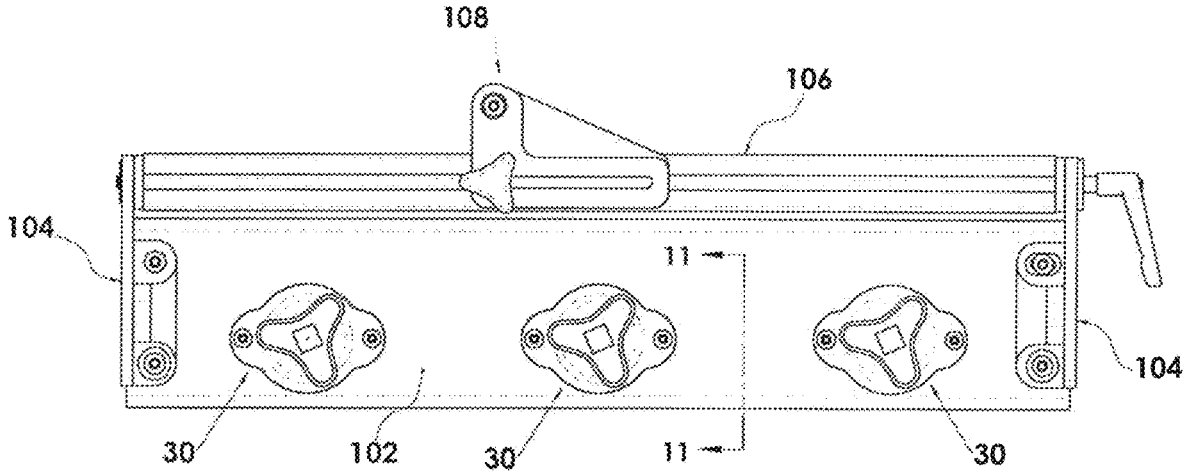
FIG. 10 is a top plan view of the fence of FIG. 9.
Figure 11:
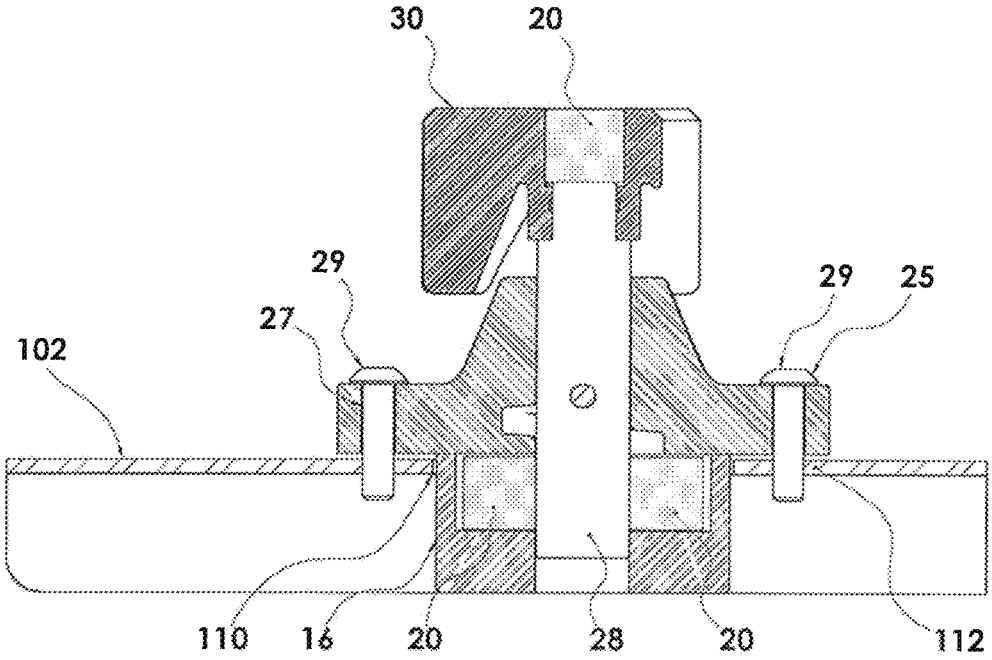
FIG. 11 is a cross-sectional view along line 11-11 of FIG. 10.

The upper housing 14 is mounted to the lower housing 16 and includes a central channel 24 in alignment with the central passage 22 of the lower housing 16 and a number of mounting tabs 25 including mounting apertures 27 to receive fasteners 29 for securing the housing 12 to the device 100, such as a cutting fence, as best shown in FIGS. 9-11. The upper housing 14 also includes a helical or spiral channel 26 that intersect and winds about the central channel 24.

Within the central passage 22 and central channel 24 is disposed a core 28 formed of a magnetic material. The core 28 extends completely through the housing 12 along the central channel 24 and central passage 22 to contact the magnets 20 in the lower housing 14 and is engaged and secured to with a handle or knob 30 adjacent the upper housing 14 for rotation therewith. Opposite the knob 30, the core 28 includes an end 21 that extends through the lower housing 16 into alignment flush with the lower surface of the housing 16.

The core 28 is movable within the housing 12 by the rotation of the knob 30, and consequent rotation of the core 28, relative to the housing 12. A pin 34 engaged with the core 28 is positioned within the spiral channel 26 to slide along the channel 26, such that the rotation of the knob 30 also rotates the core 28 and causes the pin 34 to move along the spiral channel 26. As the pin 34 is moved along the spiral channel 26 by the rotation of the knob 30, the slope of the channel 26 causes the pin 34 and correspondingly the core 28 to move up or down relative to the housing 12 in relation to the direction of rotation of the knob 30 relative to the housing 12. To facilitate the movement of the core 28 and in 34 within the housing 12, an amount of a suitable lubricant 36 can be placed on the core 28 and pin 34 within the housing 12.

In this exemplary configuration for the clamp 10, the magnets 20 disposed around the core 28, as well as the magnet 20 disposed within a recess 200 disposed in the top end of the knob 30, magnetize the core 28 such that the core 28 is provided with a magnetic flux at end 21 that can attract to a metallic surface 11 or metallic object positioned in close proximity to the core 28. As the core 28 is moved closer to a metallic support surface 11 over which the clamp 10 is positioned, the magnetic flux at the end 21 of the core 28 interacts with the metallic surface 11 to attract the surface 11 to the core 28. The rotation of the knob 30 can move the end 21 of the core 28 closer to the metallic surface 11, increasing the amount of magnetic flux interacting with the surface 11 and strengthening the attraction between the core 28 and the surface 11, maximizing the attraction when the end 21 of the core 28 is in direct contact with the surface 11. Thus, by rotating the knob 30, the user can selectively apply force from the clamp 10 to the support surface 11 to provide the desired holding force for the clamp 10 on the surface 11.

With regard to another particular exemplary embodiment of the clamp 10, the following is a description of the component parts of the clamp 10:

Hand knob (30) is attached to one end of the iron core. Twisting the knob raises and lowers the iron core relative to the metallic substrate. The knob surface in contact with operators hand is maximized to reduce stress and fatigue. Knob material is 3D printed or can be any material than is non-magnetic.

Magnetic core (28) is attached at one end to the knob. The end 21 of the core 28 can be formed with a flat end, or with an end 21 having a shape capable of altering the strength of the magnetic force exerted by the core 28 on the substrate 11. For example, a cone shaped profile can be machined into the end 21 with purpose to concentrate the magnetic lines of force. Concentration of the flux lines increases the attractive force between iron core and metallic substrate.

Iron core material can be any material that can be used to act as a conductor for magnetic flux.

Pin (34) is attached to the iron core midway down its length. The pin projects from the iron core to provide a bearing surface for lifting and lowering the magnetic core. Pin rides in acme thread internal to the upper housing. Pin material ferrous or non-ferrous Magnets (20) are equally and radially spaced about the centerline of the magnetic core. The magnets are contained within the lower housing. Magnets are in contact with the core at all times. Magnet poles are arranged such that paired and opposing north poles are facing each other. Alternatively the magnets can be arranged such that the south poles are facing each other. Either arrangement results in the same net attractive force. Maximum force is achieved when paired magnetic polarities are repulsing one another (i.e. north to north, or south to south). The magnetic force can be altered by arranging the magnetic polarities in different combinations north and south. Addition and subtraction of magnets can be arranged radially or linearly above and below one another to modify the attraction force.

Upper housing (14) features include internal acme thread, radial support for the magnetic core, and mounting holes from which the jig can be attached. Central hole in the upper housing is fitted to the magnetic core to allow a combination of rotation and linear sliding motions. Upper housing material 3D printed or can be any material that is non-magnetic.

Lower housing (16) features include cavities to retain and orient the cube magnets such that they remain equally and radially spaced about the centerline of the magnetic core, and provides support for the magnetic core. The centralized hole in lower housing is fitted to the magnetic core to allow a combination of rotation and linear sliding motions. The magnets are free to move towards and away from the magnetic core. Free movement of the magnets insures they are in constant contact with the magnetic core.

Lubricant (36) is sparingly applied to the magnetic core surface that is contact with magnets. This reduces the rotational and sliding friction. Lubricant is sparingly applied to the protruding pin to reduce rotational friction with upper housing helical spiral.

Turning the knob clockwise increases the force of attraction between jig and metallic substrate. Likewise, turning the knob counter-clockwise reduces the magnetic attraction between jig and metallic substrate. The magnetic force is thus adjustable throughout the range of knob rotation.

Majority of the pieces are 3D printed to reduce manufacturing cost, come in different colors, non-magnetic, light weight and very easy to quickly and efficiently modify design. Alternatively, the components of the clamp 10 can be formed in other suitable processes and using other suitable materials, such as non-magnetic materials for the components of the clamp 10 other than the magnets 20 and the core 28.

Maximum attractive force is achieve when the iron core is in contact with metallic substrate. Minimum force is achieved when the iron core is furthest away from the metallic substrate.

There are no fasteners required to attach the hand knob to magnetic core, or upper housing to lower housing.

1. Lower manufacturing costs to 3D print parts as opposed to die cast parts that require finishing and machining.
2. Multiple cube magnets in contact with magnetic core at all times to insure consistent and continuous magnetic attraction.
3. Magnetic core moves up and down to vary the magnetic force, while prior art clamp designs only provide for fixed magnetic force ON or OFF.

4. Total weight is less than prior art clamps. Prior art clamp materials consist of die cast upper housing, two large round diametrically polarized pair of magnets, and machined steel base.
5. Interchangeable mounting
6. 3D printing allows quick and low cost design changes that can be tailored to end user needs and expectation. Competitor cannot easily change design without incurring high cost of tooling and machining.

By being able to move the core 28 up or down relative to the housing 12, and thereby to selectively position the core 28 above or in direct contact with the metal or metallic support surface, it is possible to vary the strength of the magnetic attraction between the core 28 and the support surface. This consequently enables the strength of the magnetic holding or clamping force provided by the clamp 10 to be selected as desired.

Referring now to FIGS. 9-11, the clamp 10 is illustrated in an exemplary embodiment where the clamp 10 is disposed on an adjustable cutting fence 100, such as that disclosed in co-owned U.S. Provision Application Ser. No. 62/728,222, entitled Adjustable Cutting Fence, the entirety of which is expressly incorporated by reference herein. The fence 100 includes a base 102 and a pair of brackets 104 located at each end of the base 102. Between the brackets 104 is disposed a fence angle or barrier 106 that it rotatable with regard to the brackets 104. The barrier 106 also includes a number of stops 108 that are adjustable positioned on the barrier 106 generally opposite the base 102. The clamp 10 is secured to the base 102 of the fence 100, such as within aperture 110 in base 102 by the fasteners 29 inserted within bores 112 aligned with the aperture 110, and is utilized to releasably secure the fence 100 to a metal support surface 11 (FIG. 1) of a boring, drilling or cutting device, such as a metal platform on a miter saw (not shown). The force of the clamp 10 engaged with the support surface 11 securely holds the fence 100 on the surface 11 until the clamp 10 is disengaged, where the fence 100 can be removed from the surface 11.

Various other embodiments of the present invention are contemplated as being within the scope of the filed claims particularly pointing out and distinctly claiming the subject matter regarded as the invention.

I claim:

1. A magnetic clamp comprising:
a) a housing;
b) a core movably disposed within the housing; and
c) a number of magnets disposed in a stationary position within the housing and selectively contacted with the core to magnetize the core.

2. The magnetic clamp of claim 1 wherein the core is vertically movable relative to the housing.

3. The magnetic clamp of claim 2 wherein the core is rotationally movable with respect to the housing.

4. The magnetic clamp of claim 3 wherein the core comprises a pin movably engaged with the housing to maintain the alignment of the core with the housing.

5. The magnetic clamp of claim 4 wherein the housing includes a channel formed therein within which the pin is movably disposed.

6. The magnetic clamp of claim 5 wherein the channel is a spiral channel.

7. The magnetic clamp of claim 1 further comprising a handle connected to the core opposite the housing.

8. The magnetic clamp of claim 7 wherein the handle includes a magnet disposed therein.

9. The magnetic clamp of claim 8 wherein the magnet disposed in the handle is located adjacent and in contact with the core.

10. A magnetic clamp comprising:
a) a housing;
b) a core movably disposed within the housing; and
c) a number of magnets disposed within the housing and selectively contacted with the core to magnetize the core, wherein the housing comprises:
i) an upper housing including a number of mounting tabs; and
ii) a lower housing extending outwardly from the upper housing.

11. The magnetic clamp of claim 10 wherein the lower housing includes a number of alignment tabs engaged within bores formed in the upper housing.

12. The magnetic clamp of claim 10 wherein the lower housing and upper housing include aligned central apertures in which the core is disposed.

13. The magnetic clamp of claim 10 wherein the number of magnets are disposed in the lower housing.

14. A method for releasably securing an object to a metal or metallic support surface, the method comprising the steps of:
a) providing the magnetic clamp of claim 1;
b) placing the housing against the support surface; and
c) moving the core relative to the housing and stationary magnets within the housing to contact the core with the number of magnets and achieve the desired magnetic clamping force between the core and the support surface.

* * * * *